US005967634A

United States Patent [19]

Baca

[11] Patent Number: 5,967,634

[45] Date of Patent: Oct. 19, 1999

[54] SUPPORT BASE FOR A BUILT-IN OVEN

[75] Inventor: Isabel L Baca, Dayton, Ohio

[73] Assignee: Whirlpool Corporation, Benton Harbor, Mich.

[21] Appl. No.: 08/891,888

[22] Filed: Jul. 14, 1997

[51] Int. Cl.[6] ..... F24C 15/08

[52] U.S. Cl. ..... 312/242; 312/351.1; 126/273 A; 126/37 B; 248/678; 248/346.01

[58] Field of Search ..... 312/351.1, 242, 312/265.5, 348.1, 348.2, 348.4, 400, 410; 126/273 A, 37 R, 37 B; 248/188.1, 676, 678, 346.01, 346.02, 346.03

[56] References Cited

U.S. PATENT DOCUMENTS

| | | | |
|---|---|---|---|
| 1,756,984 | 5/1930 | Mason | 312/107 |
| 2,535,528 | 12/1950 | Brodbeck | 126/305 |
| 2,866,676 | 12/1958 | Goebel | 312/265.1 |
| 3,304,032 | 2/1967 | Yates | 248/649 |
| 5,230,553 | 7/1993 | Tuller | 312/228 |
| 5,333,825 | 8/1994 | Christensen | 248/188.2 |

*Primary Examiner*—Ramon O. Ramirez
*Assistant Examiner*—Stephen S. Wentsler
*Attorney, Agent, or Firm*—Robert O. Rice; Joel M. Van Winkle; Thomas A. Schwyn

[57] ABSTRACT

A base for a built-in oven wherein the oven is configured to be received into a cabinet cavity and the combined height of the base and oven equals the height of the cabinet cavity. The base comprises a first elongated support runner and a second elongated support runner. The support runners are positioned in a substantially parallel orientation with respect to each. A cross brace member extends between the support runners and has a first end connected to the first support runner and has a second end connected to the second support runner. A face plate assembly is attached to the front ends of the support runners. The face plate assembly includes a rigid panel connected to the front end of the first and second support runners, a frame disposed about the periphery of the rigid panel, and a thin panel secured by the frame adjacent the rigid panel.

4 Claims, 1 Drawing Sheet

SUPPORT BASE FOR A BUILT-IN OVEN

BACKGROUND OF THE INVENTION

1. Field of the Invention

This invention relates to an oven of the type which is inserted into a cabinet cavity and in particular to a support base for such an oven.

2. Description of the Related Art

Ovens which are designed to be installed into a cavity provided in a kitchen cabinet arrangement are well known. Ovens installed in this manner are commonly referred to as "built-in" ovens. Built-in ovens provide several benefits over free standing ovens. Many consumers find that built-in ovens provide an aesthetically pleasing appearance and can be attractively combined with kitchen cabinetry. Additionally, built-in ovens may be located in a cabinet cavity at a relatively high position (as compared to free standing ovens) such that accessibility to the oven interior is improved.

Unfortunately, along with the benefits there are some problems associated with built-in ovens. In particular, the installation of a built-in oven may be complicated by the need to have a correctly sized cabinet cavity to receive the oven. This problem is exacerbated by the fact the there currently exists no standardized size for built-in ovens. Cabinet oven cavities are typically fabricated to a particular size based on the particular requirements of the built-in oven model which is to be originally installed into the cabinet cavity. Subsequently, when attempting to replace the original built-in oven, a consumer may be constrained by the cabinet cavity size.

This problem affects both the oven manufacturer and the consumer. The consumer is limited in selecting a replacement oven which matches the cabinet cavity size. The manufacturer may be likewise limited in marketing and selling replacement built-in ovens based on the size of the manufacturer's built-in ovens.

Accordingly, it would be an improvement in the art to provide a means for installing a built-in oven into at least two different sized cabinet cavity openings. Specifically, it would be an improvement in the art to provide a base for built-in ovens wherein the base functions as a spacer such that the oven may be installed into a cabinet cavity having a predetermined vertical dimension substantially greater than the height of the built-in oven.

SUMMARY OF THE INVENTION

The present invention is directed to a base for a built-in oven wherein the oven is configured to be received into a cabinet cavity and the combined height of the base and oven equals the height of the cabinet cavity. The base comprises a first elongated support runner and a second elongated support runner. The support runners are positioned in a substantially parallel orientation with respect to each. A cross brace member extends between the support runners and has a first end connected to the first support runner and has a second end connected to the second support runner. A face plate assembly is attached to the front ends of the support runners. The face plate assembly includes a rigid panel connected to the front end of the first and second support runners, a frame disposed about the periphery of the rigid panel, and a thin panel secured by the frame adjacent the rigid panel.

DESCRIPTION OF THE PREFERRED EMBODIMENT

Figure 1:
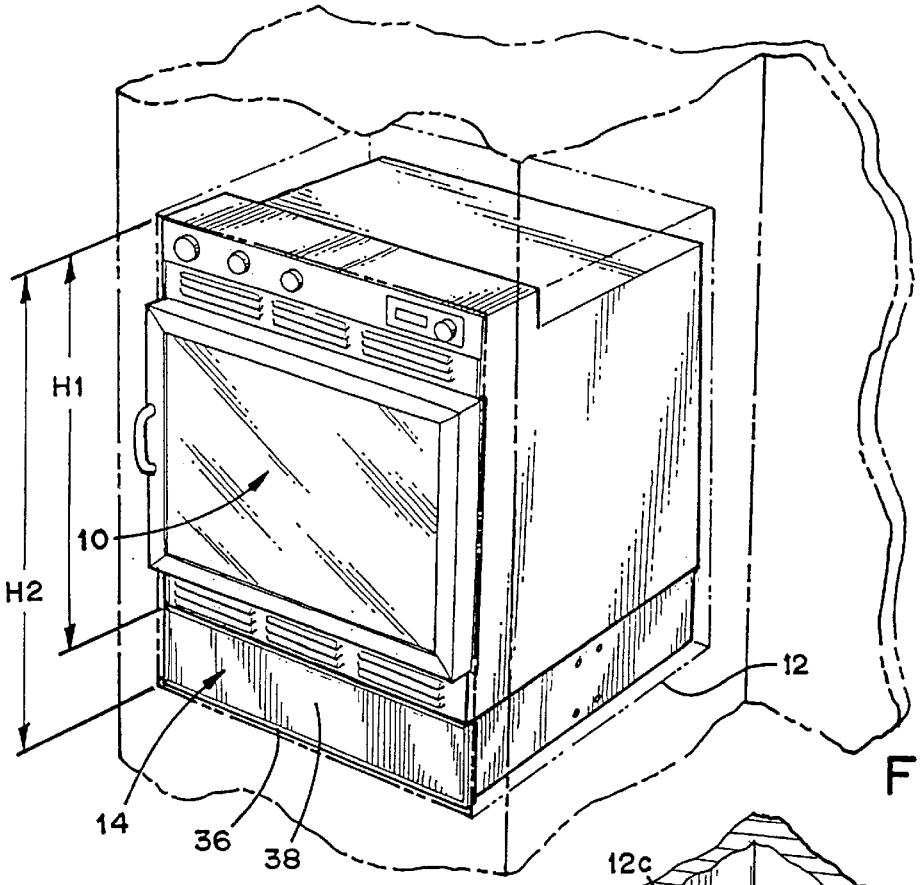
FIG. 1 is a perspective view of the oven and base assembly installed in a cabinet cavity embodying the present invention.
Figure 2:
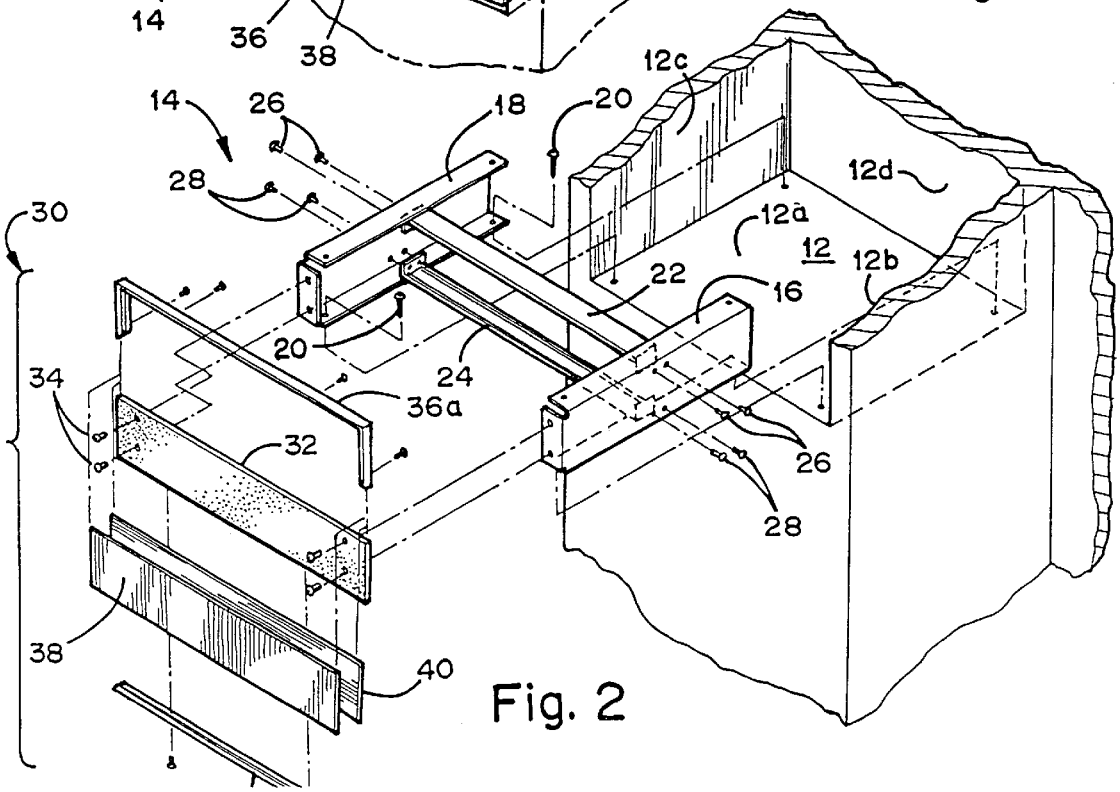
FIG. 2 is an exploded, perspective view of the base assembly of FIG. 1, removed from the cabinet cavity.

In FIG. 1 there is illustrated a built-in oven 10 positioned within a cabinet cavity 12 (FIG. 2). A base 14 is provided beneath the oven 10 for supporting the oven within the cabinet cavity 12. The base serves as a spacer or filler such that the oven 10 having a height H1 may be installed into a cavity having a greater height of H2.

FIG. 2 illustrates the details of the oven base 14. The base is mounted within the cabinet cavity 12. The cabinet cavity is defined by a bottom surface 12*a,* opposed side surfaces 12*b* and 12*c,* a back surface 12*d* and a top surface (not shown).

The base includes a first support runner 16 and a second support runner 18. The runners are arranged to fit along the side surfaces 12*b* and 12*c* of the (cabinet cavity such that the runner members are positioned in substantially parallel orientation with respect to each other. The runners may be fastened to the bottom surface 12*a* of the cabinet cavity by threaded fasteners 20. The runners 16 and 18 support the oven 10 and are of sufficient height to fill the difference between the oven height H1 and the cavity height H2.

The runner members 16 and 18 are connected to each other and spaced apart by a top cross brace member 22 and a bottom cross brace member 24 which extend between the two runners. Each of the cross brace members have a first end connected to the middle portion of the first support runner 16 and a second end connected to the middle portion of the second support runner 18. The top cross brace member 22 is connected to the top edge of the runners by fasteners 26 and is positioned above the bottom cross brace member 24 which is connected to the bottom edge of the runners by fasteners 28.

A face plate assembly 30 is mounted to the runners for providing a front surface on the base 14. The face plate assembly includes a rigid panel 32 which is mounted to the front ends of the runners 16 and 18 by fasteners 34. The rigid panel 32 may be a wood board such as plywood.

A frame 36 is disposed about the periphery of the rigid panel 32. The frame 36 may comprise a U-shaped top member 36*a* and a straight bottom strip 36*b*. The U-shaped member 36*a* assembles over the top and side edges of the rigid panel while the straight bottom strip 36*b* completes the frame by attaching to the bottom of the rigid panel 32. Both the top member 36*a* and the bottom strip 36*b* are formed from C-channel material such that the frame 36 captures the peripheral edge of the rigid panel 32.

A thin, decorative panel 38 is provided along the front surface of the rigid panel 32. The thin panel 38 is constructed to provide an aesthetically pleasing front surface on the face plate assembly 30. A corrugated sheet 40 is positioned between the thin panel 38 and the rigid panel 32. Both the thin panel and the corrugated sheet are captured and secured to the front surface of the rigid panel by the frame 36.

The face plate assembly 30 may be constructed to aesthetically match the front surface of the oven 10. This may be accomplished by forming the thin panel out of a colored plastic which matches the color of the oven. Additionally, the frame 36, formed out of the C-channel members 36*a* and 36*b,* may be colored to match the thin panel color.

Preferably, the height of the runners 16 and 18 will vary as needed for a particular installation to fill in the cavity when the oven is mounted to the base. Generally, this means that the runners are approximately equal to the difference between the cavity height H2 and the oven height H1. Similarly, the height of the face plate assembly 30 will generally be approximately equal to the height of the runners 16, 18. Therefore, regardless of the specific installation, the combined oven and base will substantially fill the cavity while presenting an aesthetically pleasing face plate that complements the built-in appearance of the oven.

It can be seen, therefore, that the present invention provides a unique system for supporting a oven within a cabinet cavity such that the oven may be installed into a cavity having a height relatively greater than the height of the oven. Although the present invention has been described with reference to specific embodiments, those of skill in the Art will recognize that changes may be made thereto without departing from the scope and spirit of the invention as set forth in the appended claims.

We claim:

1. A built-in oven assembly comprising:

a cabinet with a cabinet cavity having a predetermined height;

an oven for cooking food, the oven being disposed within the cabinet cavity; and a base structure disposed within the cabinet cavity below the oven for supporting the oven, the base structure and the oven forming a combined height, wherein the combined height of the base and the oven substantially equals the predetermined height of the cabinet cavity, the base structure including:

a first elongated support runner;

a second elongated support runner wherein the support runners are positioned in a substantially parallel orientation with respect to each other within the cabinet cavity, the runners each having corresponding front ends;

a cross brace member extending between the support runners and having a first end connected to the first support runner and having a second end connected to the second support runner; and a face plate assembly connected to the front end of each of the first and second support members.

2. The built-in oven assembly according to claim 1, further wherein the face plate assembly comprises:

a rigid panel connected to the front end of each of the first and second support members, a frame disposed about the periphery of the rigid panel, and a thin panel secured by the frame adjacent the rigid panel.

3. The built-in oven assembly according to claim 2, further wherein:

the frame comprises a plurality of C-shaped channel members which form a substantially rectangular frame when assembled to the rigid panel, the frame captures the peripheral edge of both the rigid panel and the thin panel, and the frame is secured to the rigid panel.

4. The built-in oven assembly according to claim 1, further comprising:

a second cross brace member extending between the first support runner and the second support runner adjacent the cross brace member.

* * * * *